US009510626B2

(12) United States Patent
Blomberg et al.

(10) Patent No.: US 9,510,626 B2
(45) Date of Patent: Dec. 6, 2016

(54) SLEEVE-FIT RESPIRATOR CARTRIDGE

(71) Applicant: 3M INNOVATIVE PROPERTIES COMPANY, St. Paul, MN (US)

(72) Inventors: David M. Blomberg, Lino Lakes, MN (US); Michael J. Cowell, Woodbury, MN (US); William A. Mittelstadt, Woodbury, MN (US); Carl W. Raines, III, Woodbury, MN (US); Nathan A. Abel, Minneapolis, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 575 days.

(21) Appl. No.: 13/757,434

(22) Filed: Feb. 1, 2013

(65) Prior Publication Data

US 2014/0216475 A1 Aug. 7, 2014

(51) Int. Cl.

| | |
|---|---|
| ***A41D 13/11*** | (2006.01) |
| ***A62B 18/08*** | (2006.01) |
| ***A62B 9/04*** | (2006.01) |
| *A62B 18/10* | (2006.01) |
| *A62B 23/02* | (2006.01) |
| *A62B 18/00* | (2006.01) |

(52) U.S. Cl.

CPC ..... *A41D 13/11* (2013.01); *A62B 9/04* (2013.01); *A62B 18/08* (2013.01); *A62B 18/006* (2013.01); *A62B 18/10* (2013.01); *A62B 23/02* (2013.01)

(58) Field of Classification Search

USPC ..... 128/205.27, 205.29, 206.12–206.14,128/206.19, 847, 863; 604/303; 54/80.1–80.5; 2/9, 206

See application file for complete search history.

(56) References Cited

U.S. PATENT DOCUMENTS

| | | | |
|---|---|---|---|
| 2,055,853 | A | 9/1936 | Schwartz |
| 2,062,834 | A | 12/1936 | Schwartz |
| 2,235,624 | A | 3/1941 | Schwartz |
| 2,787,333 | A | 4/1957 | Boone |
| 3,124,373 | A | 3/1964 | Thomsen |
| 3,177,018 | A | 4/1965 | Goodwin |
| 3,718,350 | A | 2/1973 | Klein |
| 3,887,222 | A | 6/1975 | Hammond |
| 3,990,727 | A | 11/1976 | Gallagher |

(Continued)

FOREIGN PATENT DOCUMENTS

| | | | |
|---|---|---|---|
| EP | 0794815 | B1 * | 8/2001 |
| KR | 10-0773460 | B1 | 11/2007 |

(Continued)

OTHER PUBLICATIONS

Koken Website, *Particulate Respirators*, web literature, http://www.koken-ltd.co.jp/english.particulaterespirators.htm., pp. 1-4, obtained from internet Jun. 3, 2013.

(Continued)

*Primary Examiner* — Ophelia A Hawthorne

(57) ABSTRACT

A respirator apparatus includes a respirator body, a filter cartridge receiver integral with and extending from the respirator body, and a filter cartridge. The filter cartridge includes a nozzle element being integral with the filter cartridge. The respirator body and filter cartridge are configured to be fluidically coupled through sleeve-fit engagement between the filter cartridge receiver and nozzle element and the filter cartridge receiver and nozzle element define an airflow channel.

16 Claims, 9 Drawing Sheets

(56) References Cited

U.S. PATENT DOCUMENTS

| | | | | |
|---|---|---|---|---|
| 4,280,491 | A | 7/1981 | Berg | |
| 4,401,326 | A | 8/1983 | Blair | |
| 4,422,861 | A | 12/1983 | Dusza | |
| 4,437,460 | A | 3/1984 | Glynn | |
| 4,462,399 | A | 7/1984 | Braun | |
| 4,548,626 | A | 10/1985 | Ackley | |
| 4,565,392 | A | 1/1986 | Vyse | |
| 4,586,500 | A | 5/1986 | Glynn | |
| 4,850,346 | A | 7/1989 | Michel | |
| 4,886,056 | A | 12/1989 | Simpson | |
| 4,921,512 | A | 5/1990 | Maryyanek | |
| 4,932,399 | A | 6/1990 | Cappa | |
| 4,934,361 | A | 6/1990 | Michel | |
| 4,965,887 | A | 10/1990 | Paoluccio | |
| 5,022,901 | A | 6/1991 | Meunier | |
| 5,033,465 | A | 7/1991 | Braun | |
| 5,036,844 | A | 8/1991 | Pouchot | |
| 5,052,725 | A | 10/1991 | Meyer | |
| 5,062,421 | A | 11/1991 | Burns | |
| 5,063,926 | A | 11/1991 | Forsgren | |
| 5,074,601 | A | 12/1991 | Spors | |
| 5,086,768 | A | 2/1992 | Niemeyer | |
| 5,090,747 | A | 2/1992 | Kotake | |
| 5,125,402 | A | 6/1992 | Greenough | |
| 5,180,377 | A | 1/1993 | Holtermann | |
| 5,222,488 | A | 6/1993 | Forsgren | |
| 5,344,626 | A | 9/1994 | Abler | |
| 5,356,183 | A | 10/1994 | Cole | |
| 5,374,088 | A | 12/1994 | Moretti | |
| RE35,062 | E | 10/1995 | Brostrom | |
| 5,496,785 | A | 3/1996 | Abler | |
| 5,579,761 | A | 12/1996 | Yuschak | |
| 5,611,925 | A | 3/1997 | Yasue | |
| 5,647,356 | A | 7/1997 | Osendorf | |
| 5,659,296 | A | 8/1997 | Debe | |
| 5,666,949 | A | 9/1997 | Debe | |
| 5,669,375 | A | 9/1997 | Dahrendorf | |
| 5,763,078 | A | 6/1998 | Braun | |
| 5,882,044 | A | 3/1999 | Sloane | |
| 5,924,420 | A | 7/1999 | Reischel | |
| 5,951,728 | A | 9/1999 | Hopson | |
| 6,014,971 | A | 1/2000 | Danisch | |
| 6,119,691 | A | 9/2000 | Angadjivand | |
| 6,139,308 | A | 10/2000 | Berrigan | |
| 6,186,140 | B1 | 2/2001 | Hoague | |
| 6,214,094 | B1 | 4/2001 | Rousseau | |
| 6,216,693 | B1 | 4/2001 | Rekow | |
| 6,250,299 | B1 | 6/2001 | Danisch | |
| 6,298,849 | B1 | 10/2001 | Scholey | |
| 6,345,620 | B2 | 2/2002 | Salapow | |
| 6,375,886 | B1 | 4/2002 | Angadjivand | |
| 6,382,206 | B1 * | 5/2002 | Palazzotto | A62B 18/08 128/201.19 |
| 6,391,429 | B1 | 5/2002 | Senkus | |
| 6,397,458 | B1 | 6/2002 | Jones | |
| 6,406,657 | B1 | 6/2002 | Eitzman | |
| 6,409,806 | B1 | 6/2002 | Jones | |
| 6,454,986 | B1 | 9/2002 | Eitzman | |
| 6,478,025 | B1 | 11/2002 | Yort | |
| 6,550,479 | B1 | 4/2003 | Duxbury | |
| 6,575,165 | B1 | 6/2003 | Cook | |
| 6,627,563 | B1 | 9/2003 | Huberty | |
| 6,660,210 | B2 | 12/2003 | Jones | |
| 6,743,646 | B2 | 6/2004 | Jakatdar | |
| 6,761,169 | B2 | 7/2004 | Eswarappa | |
| 6,793,702 | B2 | 9/2004 | Eswarappa | |
| 6,874,499 | B2 | 4/2005 | Viner | |
| 7,320,722 | B2 | 1/2008 | Mittelstadt | |
| 7,419,526 | B2 | 9/2008 | Greer | |
| 8,505,536 | B2 | 8/2013 | Kielow | |
| 2001/0013347 | A1 | 8/2001 | Rekow | |
| 2002/0195109 | A1 | 12/2002 | Mittelstadt | |
| 2003/0217752 | A1 | 11/2003 | Muller | |
| 2004/0003810 | A1 | 1/2004 | Templeton | |
| 2005/0126572 | A1 | 6/2005 | Gosweiler | |
| 2009/0217926 | A1 | 9/2009 | Hine | |
| 2010/0307506 | A1 | 12/2010 | Kielow | |
| 2011/0284006 | A1 * | 11/2011 | Legare et al. | 128/205.27 |
| 2012/0000465 | A1 | 1/2012 | Cavaliere | |
| 2012/0024289 | A1 | 2/2012 | Johnstone | |
| 2012/0174922 | A1 | 7/2012 | Virr | |
| 2013/0125896 | A1 * | 5/2013 | Dwyer | A62B 18/02 128/206.17 |
| 2014/0216473 | A1 | 8/2014 | Dwyer | |
| 2014/0216474 | A1 | 8/2014 | Mittelstadt | |
| 2014/0216475 | A1 | 8/2014 | Blomberg | |

FOREIGN PATENT DOCUMENTS

| | | |
|---|---|---|
| WO | WO 99/46006 | 11/1999 |
| WO | WO 03/090873 A1 | 11/2003 |
| WO | WO 03/099385 | 12/2003 |
| WO | WO 2007117688 | 10/2007 |
| WO | WO 2008/082415 | 7/2008 |
| WO | WO 2011/006206 | 1/2011 |

OTHER PUBLICATIONS

International Application PCT/US2014/012197 Search Report dated Aug. 27, 2014.

* cited by examiner

SLEEVE-FIT RESPIRATOR CARTRIDGE

FIELD

The disclosure relates to respirator cartridges that have an interface for lateral engagement with respirator apparatus.

BACKGROUND

Respirators can include a full face mask body or a half mask body or a body element of a Positive Air Pressure Respirator (PAPR). One or more filter cartridges can be attached to these respirators. Air is drawn through the filter cartridge by a negative pressure generated by either a wearer of the masks or by a blower in the PAPR. This air passes through the filter medium and then enters the mask body interior where the filtered air is then inhaled by the respirator user.

Many techniques have been used to attach filter cartridges to respirators. One technique has the filter element disposed in a threaded cartridge that is attached to a corresponding threaded fitting on the body of the respirator. Filter cartridges can possess helical or advancing spiral threads that mate with a tapped collar or socket that receives the threaded portion of the filter cartridge. Rotating the filter cartridge in an appropriate direction allows the cartridge to be attached to or removed from the respirator. A resilient, deformable gas can be used to ensure an airtight fit to the respirator body.

In lieu of threads, a bayonet type closure has been used to attach a filter cartridge to a respirator. The bayonet type connector inserts into a complementary connector portion of a mask body and a filter cartridge may be rotated to engage tabs until the tabs engage the ends of the corresponding slots, providing a positive rotational stop point. This configuration provides for automatic alignment and orientating air filter cartridges relative to the respirator.

BRIEF SUMMARY

The disclosure relates to respirator cartridges that have an interface for lateral engagement with respirator apparatus. In particular the disclosure relates to sleeve-fit respirator cartridges that include a cantilever latch extending from the cartridge that is configured to cooperate with a mating surface on the respirator body.

In a first aspect of the disclosure, a respirator apparatus includes a respirator body, a filter cartridge receiver integral with and extending from the respirator body, and a filter cartridge. The filter cartridge includes a nozzle element being integral with the filter cartridge. The respirator body and filter cartridge are configured to be fluidically coupled through sleeve-fit engagement between the filter cartridge receiver and nozzle element and the filter cartridge receiver and nozzle element define an airflow channel.

In a second aspect of the disclosure, a respirator cartridge includes a nozzle element defining an airflow channel and being integral with a filter cartridge, and a cantilever latch adjacent the nozzle and extending from the filter cartridge.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

The disclosure may be more completely understood in consideration of the following detailed description of various embodiments of the disclosure in connection with the accompanying drawings, in which.

DETAILED DESCRIPTION

Figure 1:
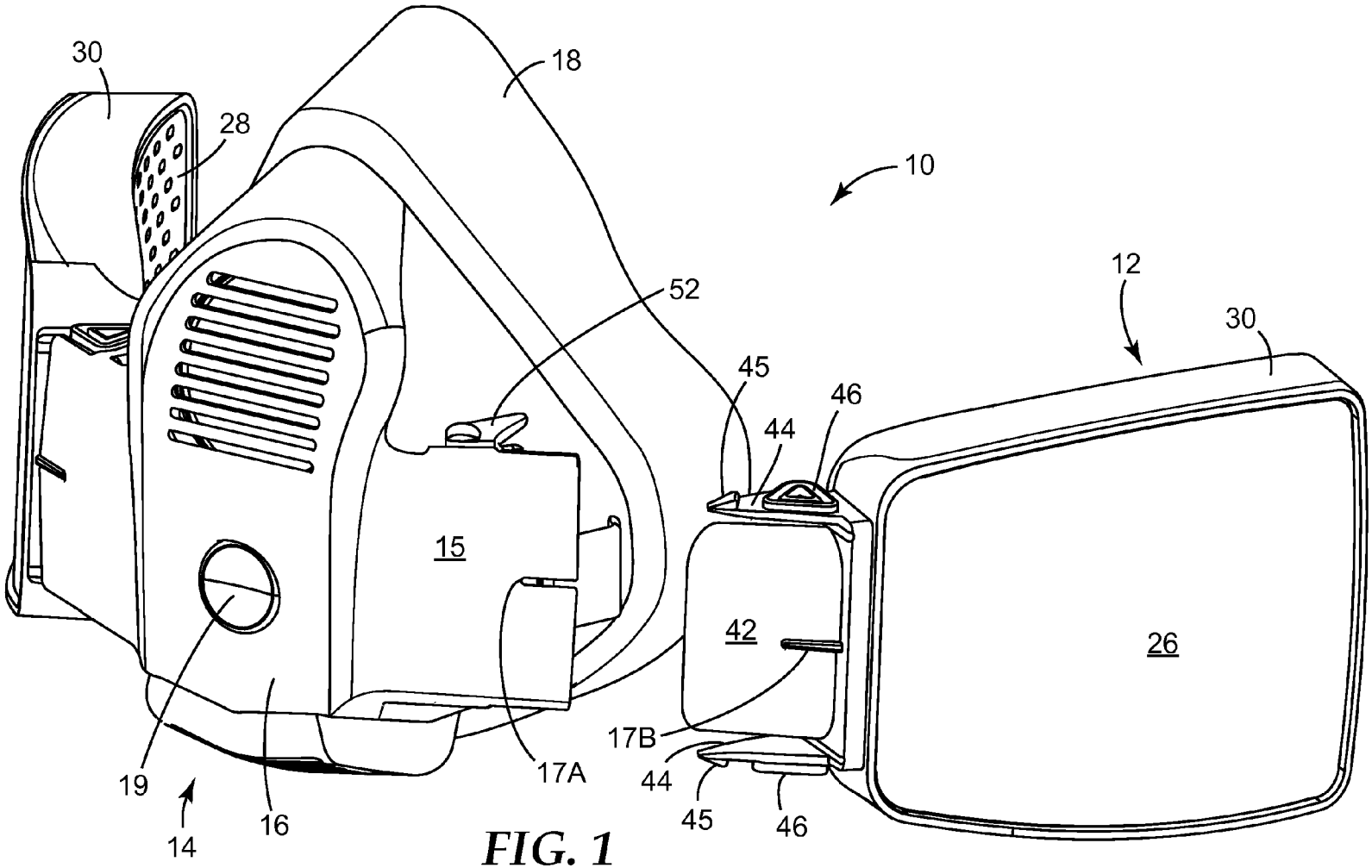
FIG. 1 is a perspective view of an illustrative half mask respirator and a disengaged sleeve-fit respirator cartridge.

In the following detailed description, reference is made to the accompanying drawings that form a part hereof, and in which are shown by way of illustration several specific embodiments. It is to be understood that other embodiments are contemplated and may be made without departing from the scope or spirit of the present disclosure. The following detailed description, therefore, is not to be taken in a limiting sense.

All scientific and technical terms used herein have meanings commonly used in the art unless otherwise specified. The definitions provided herein are to facilitate understanding of certain terms used frequently herein and are not meant to limit the scope of the present disclosure.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise.

Spatially related terms, including but not limited to, "lower," "upper," "beneath," "below," "above," and "on top," if used herein, are utilized for ease of description to describe spatial relationships of an element(s) to another. Such spatially related terms encompass different orientations of the device in use or operation in addition to the particular orientations depicted in the figures and described herein. For example, if an object depicted in the figures is turned over or flipped over, portions previously described as below or beneath other elements would then be above those other elements.

As used herein, when an element, component or layer for example is described as forming a "coincident interface" with, or being "on", "connected to," "coupled with", "in contact with", "separating" or "adjacent" another element, component or layer, it can be directly on, directly connected to, directly coupled with, in direct contact with, or intervening elements, components or layers may be on, connected, coupled or in contact with or separating the particular element, component or layer, for example. When an element, component or layer for example is referred to as being "directly on," "directly connected to," "directly coupled with," or "directly in contact with" another element, there are no intervening elements, components or layers for example.

As used herein, "have", "having", "include", "including", "comprise", "comprising" or the like are used in their open ended sense, and generally mean "including, but not limited to." It will be understood that the terms "consisting of" and "consisting essentially of" are subsumed in the term "comprising," and the like.

The term "filter cartridge" refers to a device that is attachable to a respirator for purposes of filtering air before it enters the interior air space between a mask body and a person's face. The term "respirator cartridge" is used interchangeably with "filter cartridge" herein.

The term "respirator" refers to a device that is worn by a person to filter air before the air enters the person's respiratory system.

The term "integral" refers to being made at the same time or being incapable of being separated without damaging one or more of the integral parts.

The term "cartridge sidewall" means an air-impermeable surface that is located at a portion of the side of a cartridge.

The term "mask body" refers to the structure that fits at least over the nose and mouth of a person and that helps define an interior air space separated from an exterior air space.

The term "sleeve-fit" refers to a lateral engagement of two elements where one element slides into a channel defined by the other element.

The disclosure relates to respirator cartridges that have an interface for lateral engagement with respirator apparatus, among other aspects. In particular the disclosure relates to sleeve-fit respirator cartridges are configured to be fluidically coupled through sleeve-fit engagement between a filter cartridge receiver on the respirator and a nozzle element on the respirator cartridge. In one or more embodiments, the respirator cartridge can include a cantilever latch extending from the cartridge that is configured to cooperate with a mating surface on the respirator body. In other embodiments, the respirator body or filter cartridge receiver on the respirator can include a cantilever latch extending from the respirator body or filter cartridge receiver that is configured to cooperate with a mating surface on the nozzle element on the respirator cartridge. In many embodiments, the cantilever latch can be parallel with a nozzle element that defines an airflow channel and is integral with a cartridge sidewall. In some embodiments the cantilever latch extends from the nozzle element. The cantilever latch can include both an anchoring protrusion to secure the respirator cartridge to the respirator and a push button protrusion to release or detach the respirator cartridge from the respirator. In some embodiments the anchoring protrusion and the push button protrusion are the same protrusion element. In one or more embodiments, the respirator cartridge includes an alignment element that cooperates with an alignment element on the respirator to laterally align and laterally secure the respirator cartridge to the respirator. The alignment elements can also provide side to side or rotational stability to the respirator cartridge to the respirator. While the present disclosure is not so limited, an appreciation of various aspects of the disclosure will be gained through a discussion of the examples provided below.

Figure 2A:
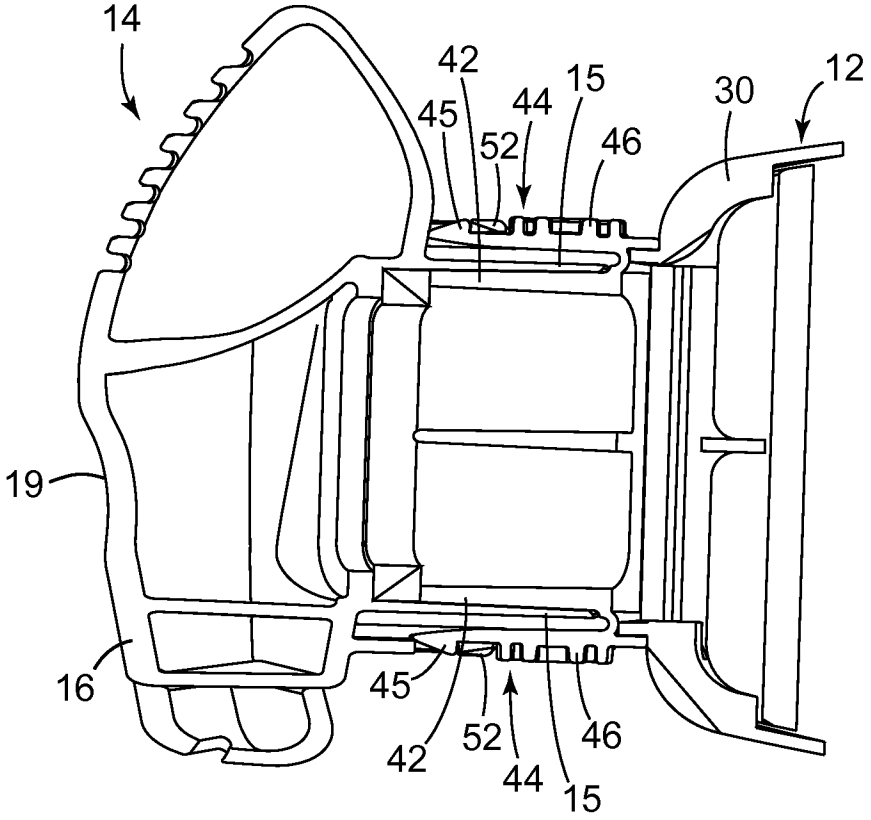
FIG. 2A is a vertical cross-sectional view of the sleeve-fit portion of an engaged respirator cartridge and filter cartridge receiver.
Figure 2B:
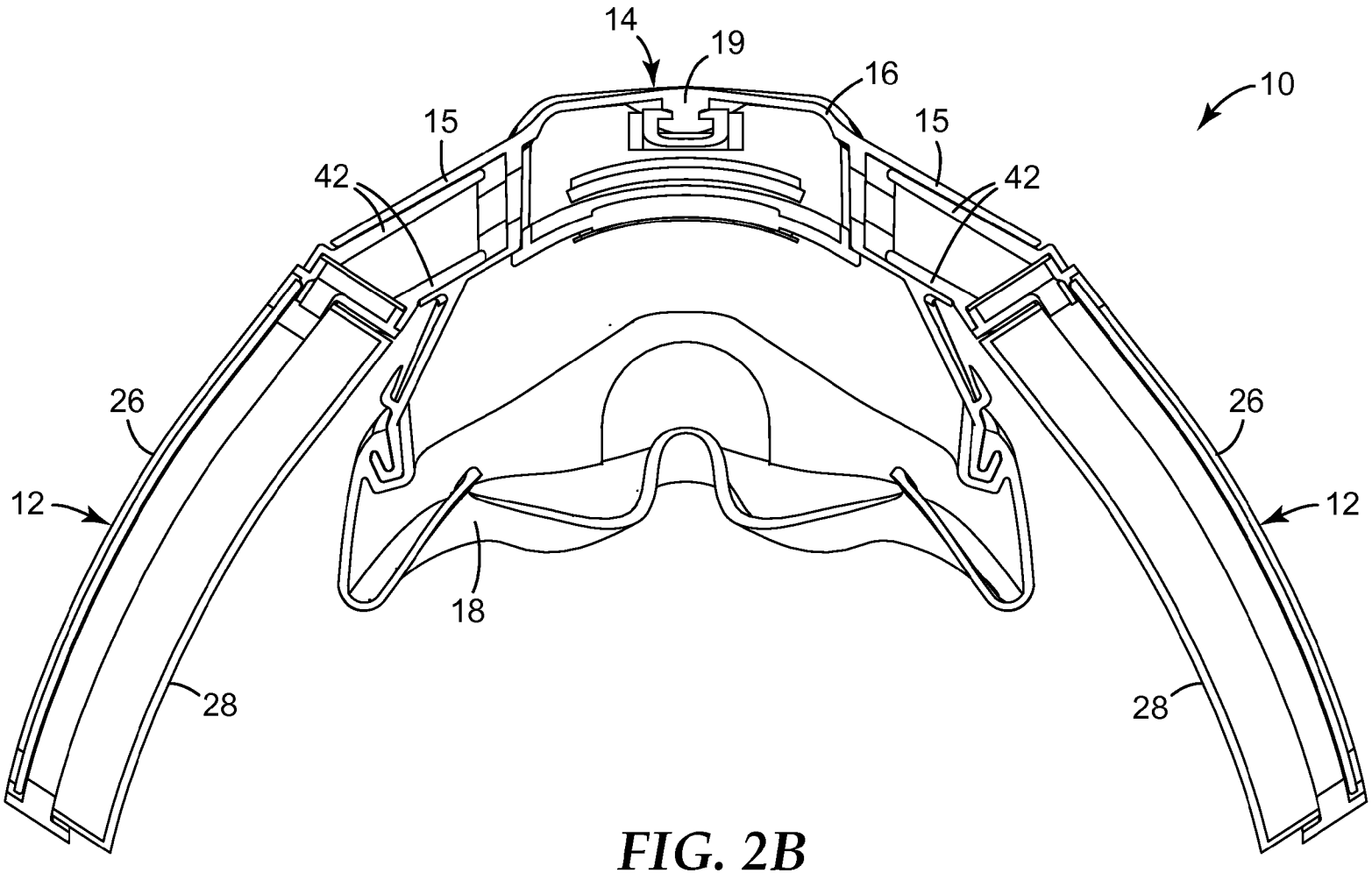
FIG. 2B is a horizontal cross-sectional view of the illustrative half mask respirator and a engaged sleeve-fit respirator cartridges of FIG. 1.
Figure 3:
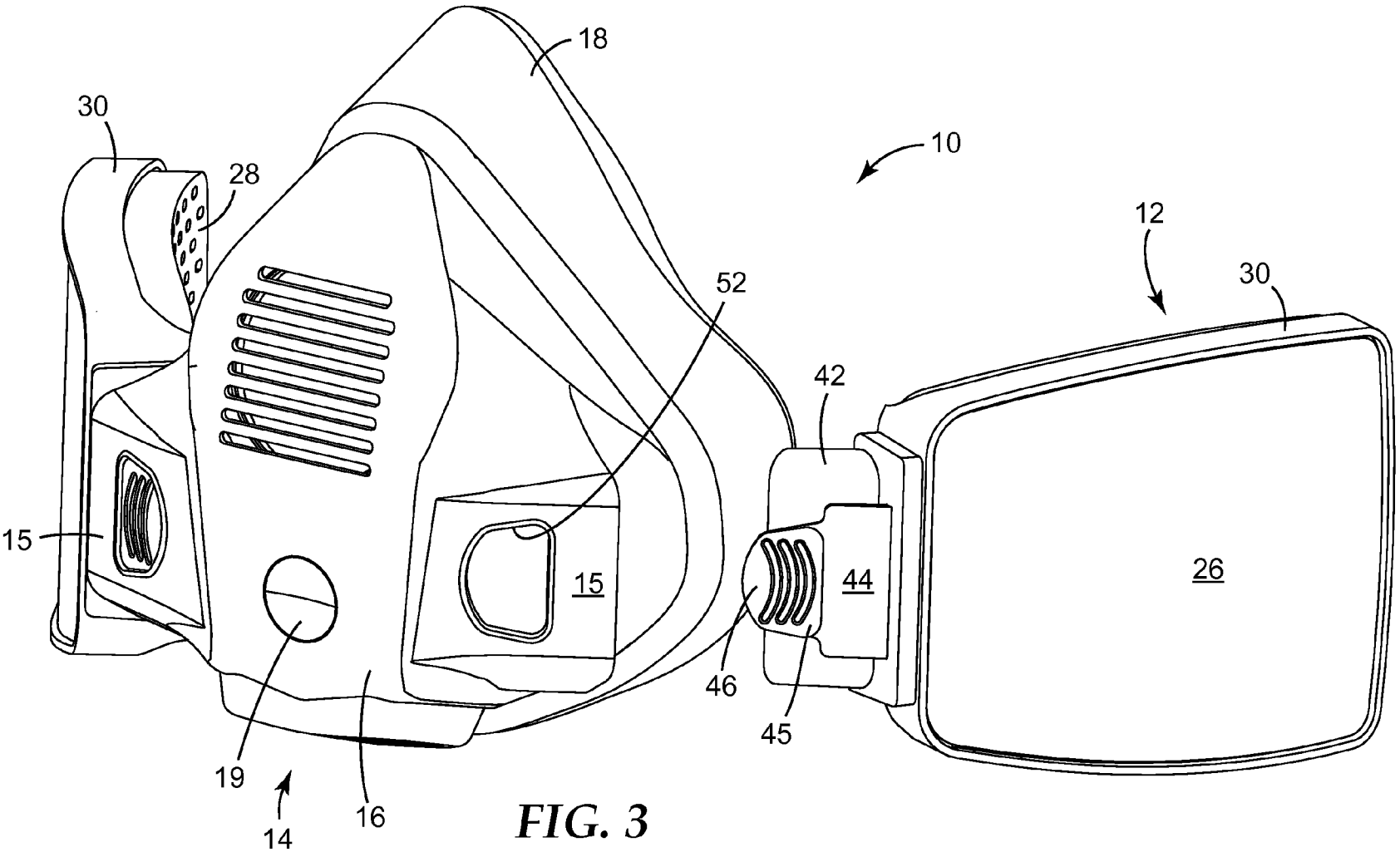
FIG. 3 is a perspective view of another illustrative half mask respirator and a disengaged sleeve-fit respirator cartridge.
Figure 4:
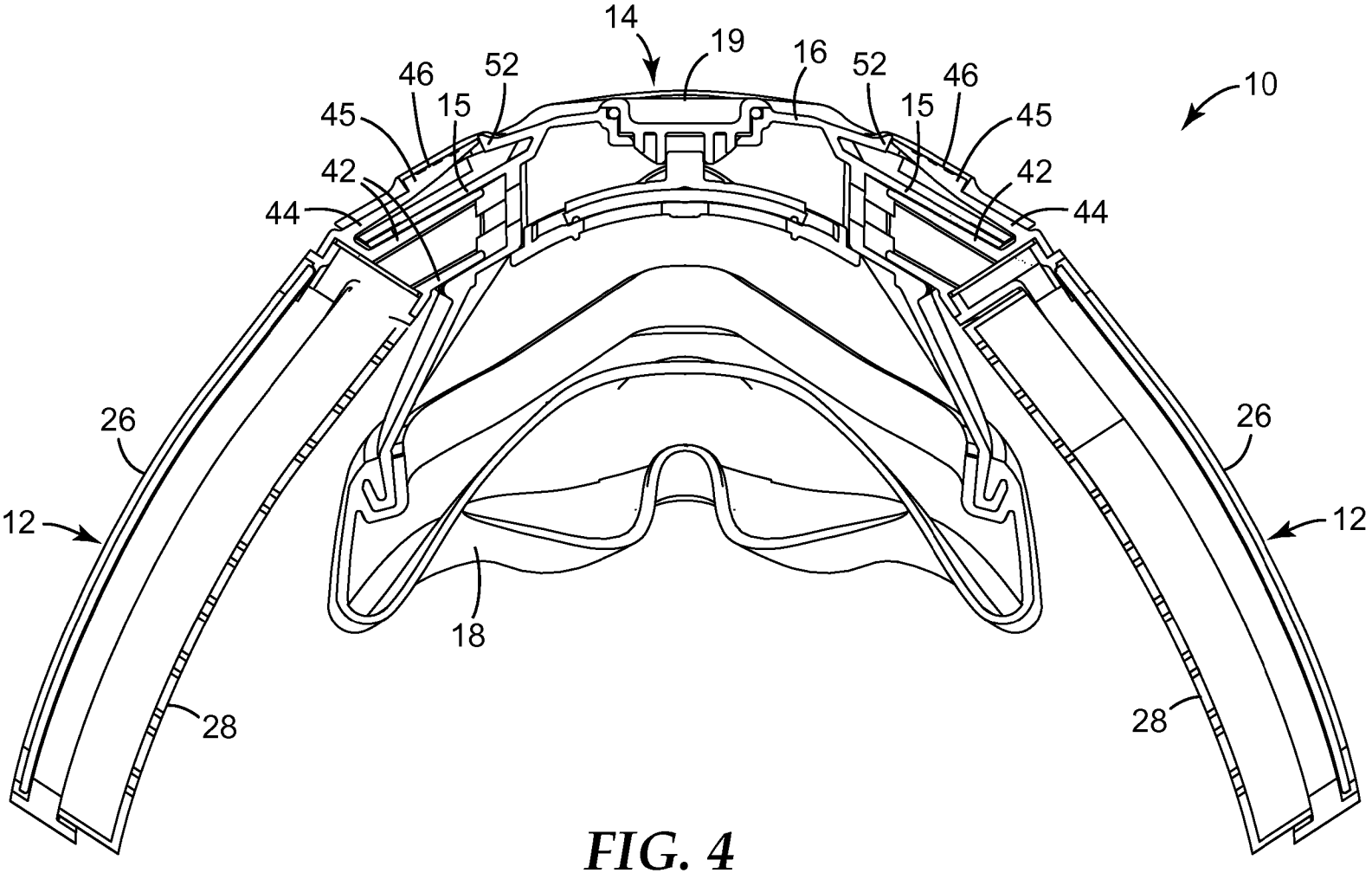
FIG. 4 is a horizontal cross-sectional view of the illustrative half mask respirator and a engaged sleeve-fit respirator cartridges of FIG. 3.
Figure 5:
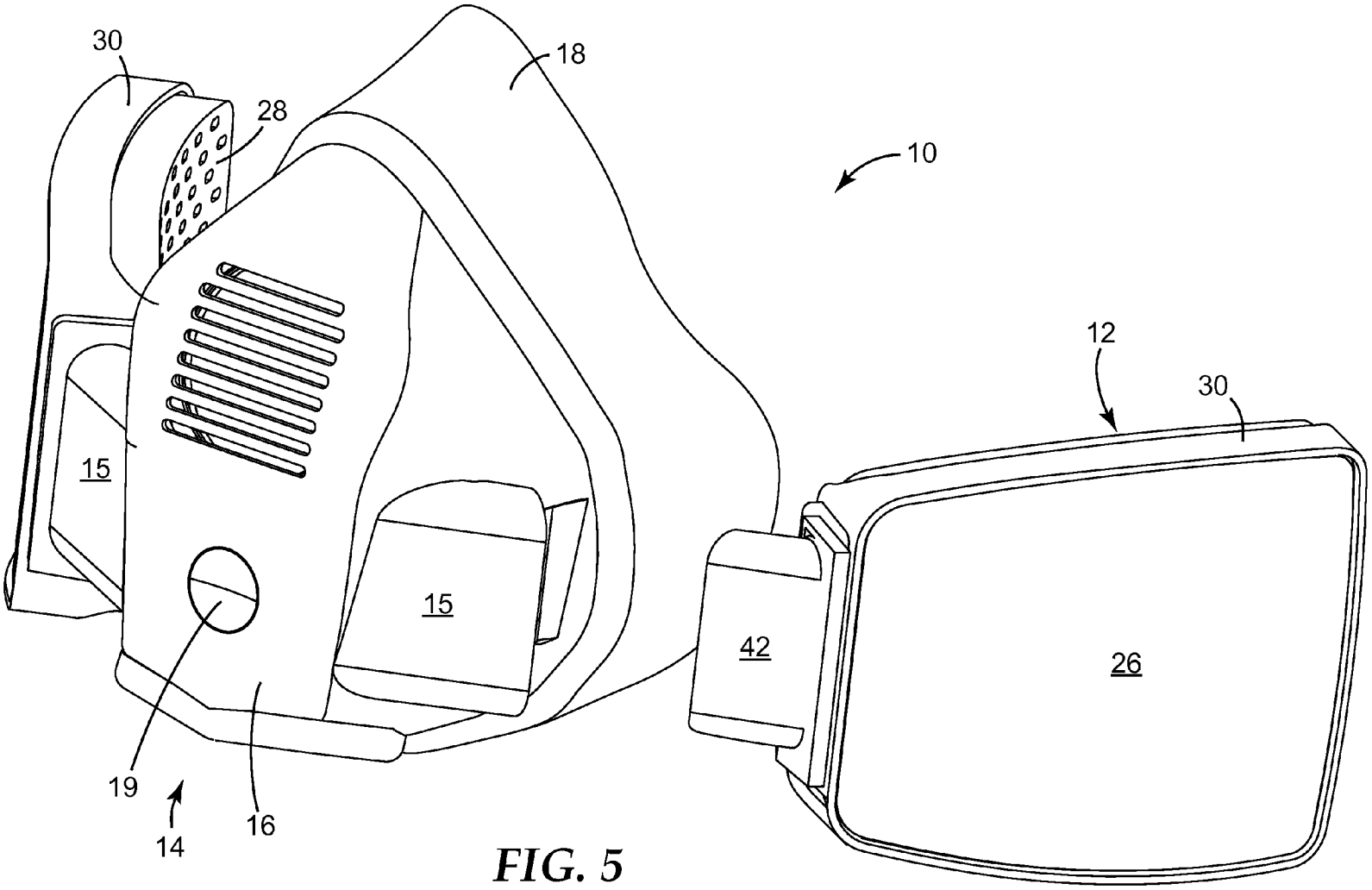
FIG. 5 is a perspective view of another illustrative half mask respirator and a disengaged sleeve-fit respirator cartridge.
Figure 6:
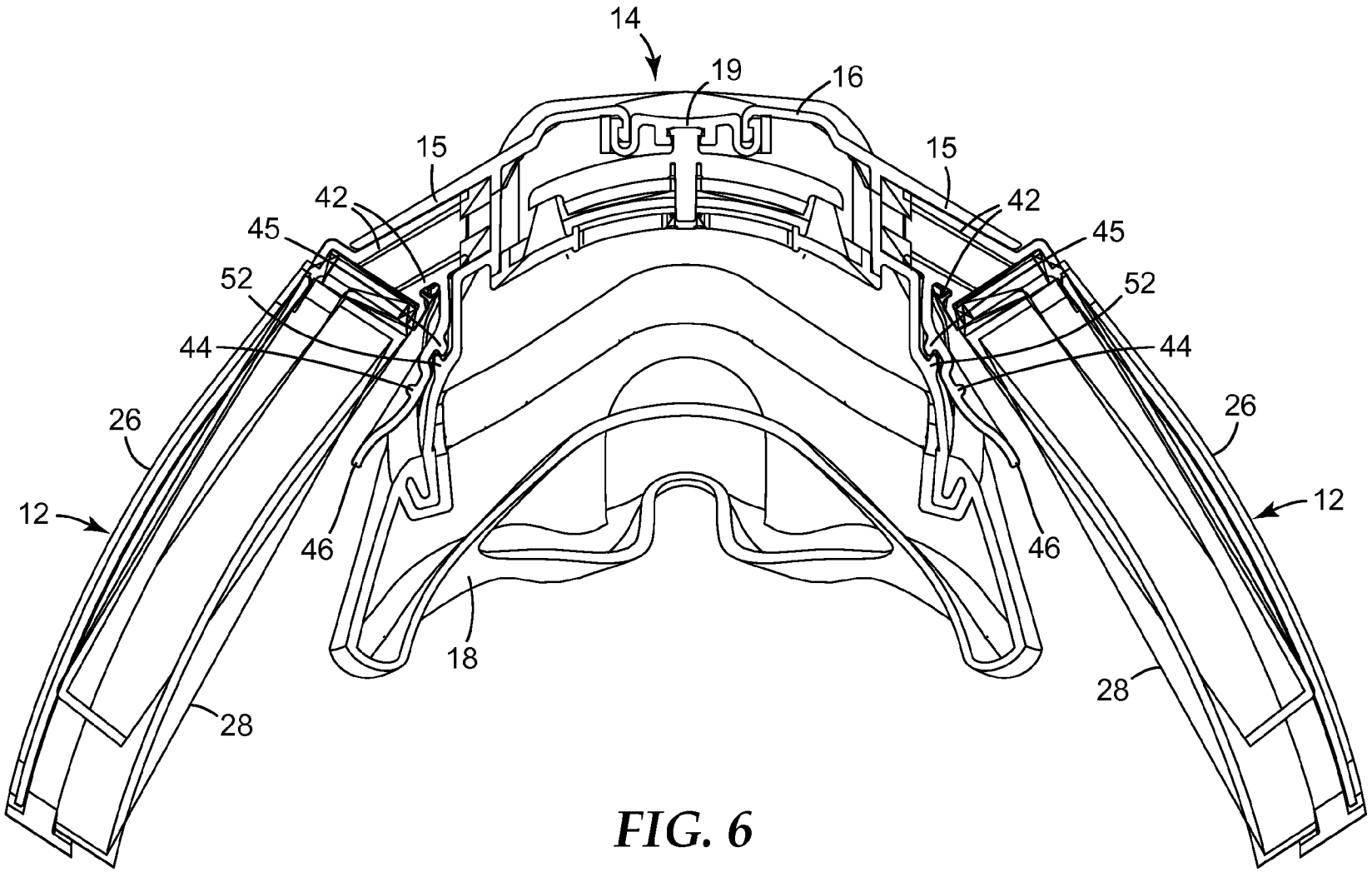
FIG. 6 is a horizontal cross-sectional view of the illustrative half mask respirator and a engaged sleeve-fit respirator cartridges of FIG. 5.

FIG. 1 is a perspective view of an illustrative half mask respirator 10 and a disengaged sleeve-fit respirator cartridge 12. FIG. 2A is a vertical cross-sectional view of the sleeve-fit portion of an engaged respirator cartridge 12 and filter cartridge receiver 15. FIG. 2B is a horizontal cross-sectional view of the illustrative half mask respirator 10 and a engaged sleeve-fit respirator cartridges 12 of FIG. 1. FIG. 3 is a perspective view of another illustrative half mask respirator 10 and a disengaged sleeve-fit respirator cartridge 12. FIG. 4 is a horizontal cross-sectional view of the illustrative half mask respirator 10 and a engaged sleeve-fit respirator cartridges 12 of FIG. 3. FIG. 5 is a perspective view of another illustrative half mask respirator 10 and a disengaged sleeve-fit respirator cartridge 12. FIG. 6 is a horizontal cross-sectional view of the illustrative half mask respirator 10 and a engaged sleeve-fit respirator cartridges 12 of FIG. 5.

The illustrative respirator 10 is a half mask respirator that can be worn by a person on their head, covering the nose and mouth and defining an interior air space. The respirator 10 has one or more filter cartridges 12 located on opposing sides of the mask body 14. The filter cartridges 12 are releasably attached from the mask body 14 via a sleeve-fit engagement.

The filter cartridges 12 filter ambient air before it passes into the interior air space between the mask body 14 and a user. The mask body 14 can include a rigid insert 16 and an elastomeric face contacting portion 18. An exhalation valve 19 may be placed on the mask body 14 to allow exhaled air to be purged from the interior air space. The respirator 10 can also have a harness (not shown) for supporting the mask body 14 on the wearer's head when the respirator is being worn.

In one or more embodiments, the filter cartridges 12 that are secured to the mask body 14 have first and second major surfaces 26 and 28 and a housing or cartridge sidewall 30. The cartridge sidewall 30 extends at least from the first major surface 26 to at least the second major surface 28. In illustrative embodiments, the cartridge sidewall 30 commonly meets the perimeter of the layer(s) of filter media that are located therein. At the cartridge sidewall 30, one or both of the major surfaces 26 and 28 meet. One or more of these surfaces 26 and 28, or a portion of surfaces 26 and 28, may be fluid permeable to allow ambient air to enter the filter cartridge 12. In other embodiments, the filter cartridges 12 that are secured to the mask body 14 have first and second major surfaces 26 and 28 that are essentially filter media and are welded together along a side edge.

In many embodiments, a respirator apparatus includes a respirator body 14, a filter cartridge receiver 15 integral with and extending from the respirator body 14, and a filter cartridge 12. The filter cartridge 12 includes a nozzle element 42 being integral with a filter cartridge 12. In one or more embodiments, nozzle element 42 is integral with a cartridge sidewall 30. The respirator body 14 and filter cartridge 12 are configured to be fluidically coupled through sleeve-fit engagement between the filter cartridge receiver 15 and nozzle element 42. While the nozzle element 42 is illustrated as being received in an opening defined by the filter cartridge receiver 15, it is understood that the filter cartridge receiver 15 can be configured to be received in an opening defined by the nozzle element 42. The filter cartridge receiver 15 and nozzle element 42 cooperate to form an airflow channel.

The nozzle element 42 extends a first lateral distance away from the filter cartridge 12 and the filter cartridge receiver 15 extends a second lateral distance away from the respirator body 14. A "sleeve-fit" engagement refers to the lateral engagement of the nozzle element 42 and filter cartridge receiver 15 where one of these element slides into a channel defined by the other element at least any useful lateral distance. In one or more embodiments, this lateral distance is at least 50%, or at least 75%, or at least 90% or 100% of either the first lateral distance or second lateral distance. In some embodiments, this lateral distance is at least 50%, or at least 75%, or at least 90% of the larger of the first lateral distance or second lateral distance. In many embodiment, a sleeve-fit engagement with nozzle element 42 and filter cartridge receiver 15 provides a stable connection between the two elements and can inhibit or prevent relative rotation between the two elements, among other advantages. For example, nozzle element 42 and filter cartridge 15 may exhibit a non-circular shape that prevents rotation, and a relatively large lateral distance of engagement prevents a side or portion of nozzle element 42 from becoming disengaged from cartridge receiver 15.

In many embodiments the respirator 10 includes a cantilever latch 44 that secures the filter cartridge nozzle element 42 to the filter cartridge receiver 15. In one or more embodiments, the cantilever latch 44 is integral with the filter cartridge 12, as illustrated. In these embodiments, the filter cartridge receiver 15 or respirator body 14 includes a mating surface 52 that cooperates with the cantilever latch 44 to secure the filter cartridge nozzle element 42 to the filter cartridge receiver 15. In other embodiments, the cantilever latch 44 is integral with the filter cartridge receiver 15 or respirator body 14. In these embodiments, the filter cartridge nozzle element 42 includes a mating surface that cooperates with the cantilever latch to secure the filter cartridge nozzle element 42 to the filter cartridge receiver 15.

In one or more embodiments, the cantilever latch 44 extends from the cartridge sidewall 30 and is substantially parallel with the nozzle element 42, as illustrated in FIG. 1, FIG. 2A, FIG. 3 and FIG. 4. In some embodiments, the filter cartridge 12 includes a pair of cantilever latches 44 extending from the cartridge side wall 30 and being substantially parallel or co-extending with the nozzle element 42, and the nozzle element 42 is positioned between the pair of cantilever latches 44, as illustrated in FIG. 1 and FIG. 2A. In one or more embodiments the cantilever latch 44 extends from the nozzle element 42, as illustrated in FIG. 5 and FIG. 6. In the exemplary embodiment of FIG. 6, cantilever latch 44 extends from portion of nozzle element 42 proximate respirator body 14 such that cantilever latch is positioned substantially between filter cartridge 12 and respirator body 14. A cantilever latch positioned between a cartridge and respirator body protects cantilever latch from inadvertent contact and provides additional security against inadvertent separation of a cartridge from a respirator body, for example.

In many embodiments, one or more alignment features 17A, 17B cooperate to register the nozzle element 42 to the filter cartridge receiver 15. As illustrated in FIG. 1, for example, a first alignment feature 17A cooperates with a second alignment feature 17B to align and secure the nozzle element 42 to the filter cartridge receiver 15. In illustrative embodiments, one of the first alignment feature and the second alignment feature is an elongated protrusion that is parallel with a direction of the sleeve-fit engagement. For example, the first alignment feature 17A can be an elongated channel on the filter cartridge receiver 15 that extends laterally along a direction of the sleeve-fit engagement, and the second alignment feature 17B can be an elongated protrusion on the nozzle element 42 that extends laterally along a direction of the sleeve-fit engagement. Sleeve-fit engagement of the nozzle element 42 into the filter cartridge receiver 15 mates the first alignment feature 17A cooperates with a second alignment feature 17B to align and secure the nozzle element 42 to the filter cartridge receiver 15. These alignment elements laterally align and laterally secure the respirator cartridge to the respirator. These alignment elements can also provide side to side or rotational stability to the respirator cartridge to the respirator. In addition, due the small scale of these elements, they are less prone to environmental expansion and contraction effects. While these alignment elements are illustrated in FIG. 1, it is understood that these alignment elements can be utilized in any embodiment of the disclosure.

In one or more embodiments, the cantilever latch 44 includes an anchoring protrusion 45 located along a length of the cantilever latch 44. The anchoring protrusion 45 is configured to secure the respirator cartridge 12 to a respirator article. If present, the anchoring protrusion 45 can be located at any location on the respirator article such as on the mask body 14, filter cartridge receiver 15, cantilever latch 44, or filter cartridge 12.

As illustrated in FIG. 1 and FIG. 2A, the cantilever latch 44 can include an anchoring protrusion 45 located at a distal end of the cantilever latch 44 and a push button protrusion 46 located along a length of the cantilever latch 44. The push button protrusion 46 is configured to detach the respirator cartridge 12 from a respirator article. An user can apply force or pressure to the push button protrusion 46 to deflect the cantilever latch 44 and detach the anchoring protrusion 45 from the mating surface 52 and disengage or remove the respirator cartridge 12 from the respirator article. As illustrated in FIG. 3 and FIG. 4 the cantilever latch 44 includes an anchoring protrusion 45 located along a length and not at a distal end of the cantilever latch 44 and a push button protrusion 46 located along a length of the cantilever latch 44 and between the distal end and anchoring protrusion 45. In some of these embodiments, the anchoring protrusion element 45 is configured to both secure the respirator cartridge to the respirator article and to detach the respirator cartridge from a respirator article. As illustrated in FIG. 5 and FIG. 6 the cantilever latch 44 can include an anchoring protrusion 45 located along a length and not at a distal end of the cantilever latch 44 and a push button protrusion 46 at the distal end of the cantilever latch 44.

Figure 7:
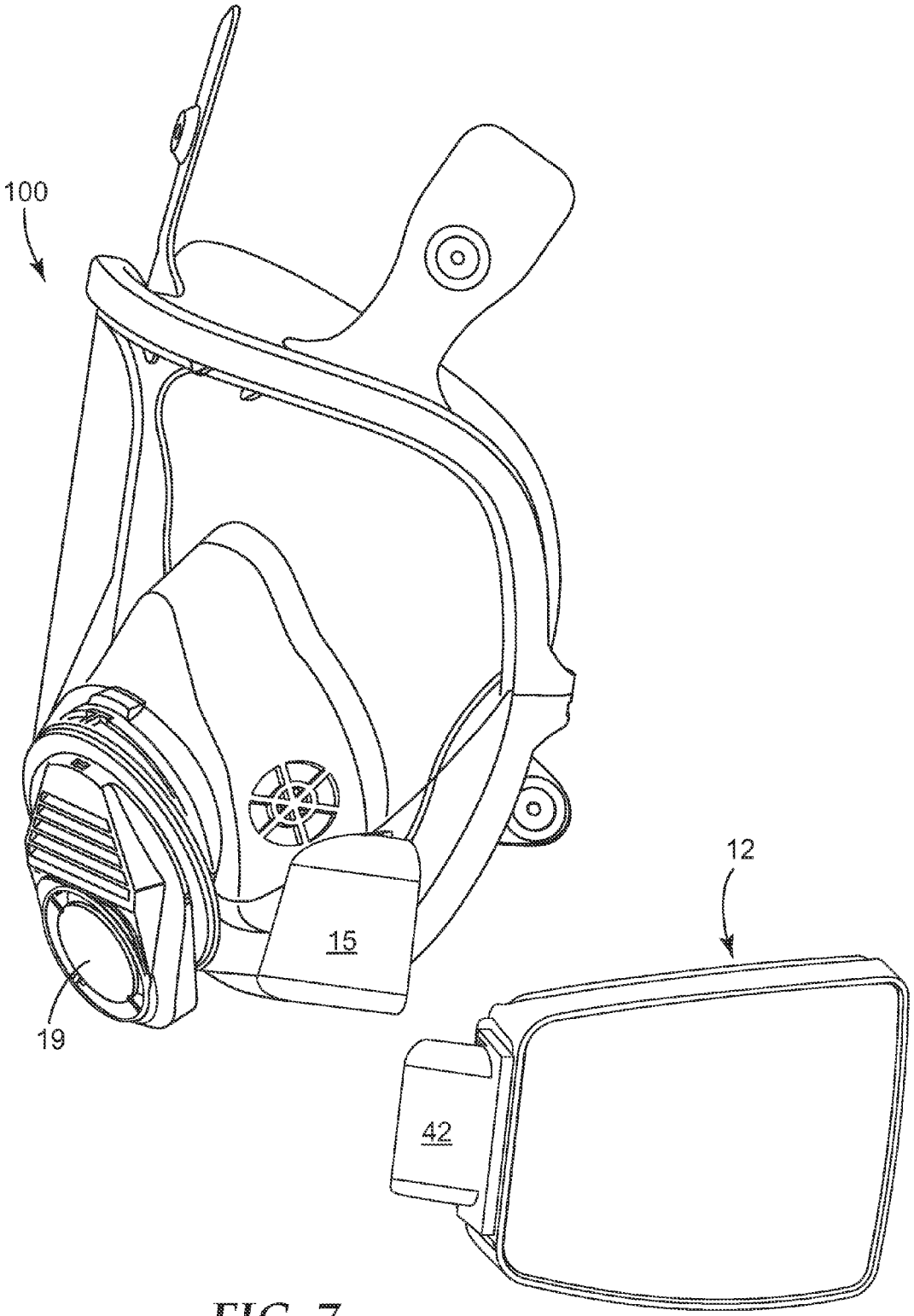
FIG. 7 is a perspective view of a illustrative full mask respirator and a disengaged sleeve-fit respirator cartridge.
Figure 8:
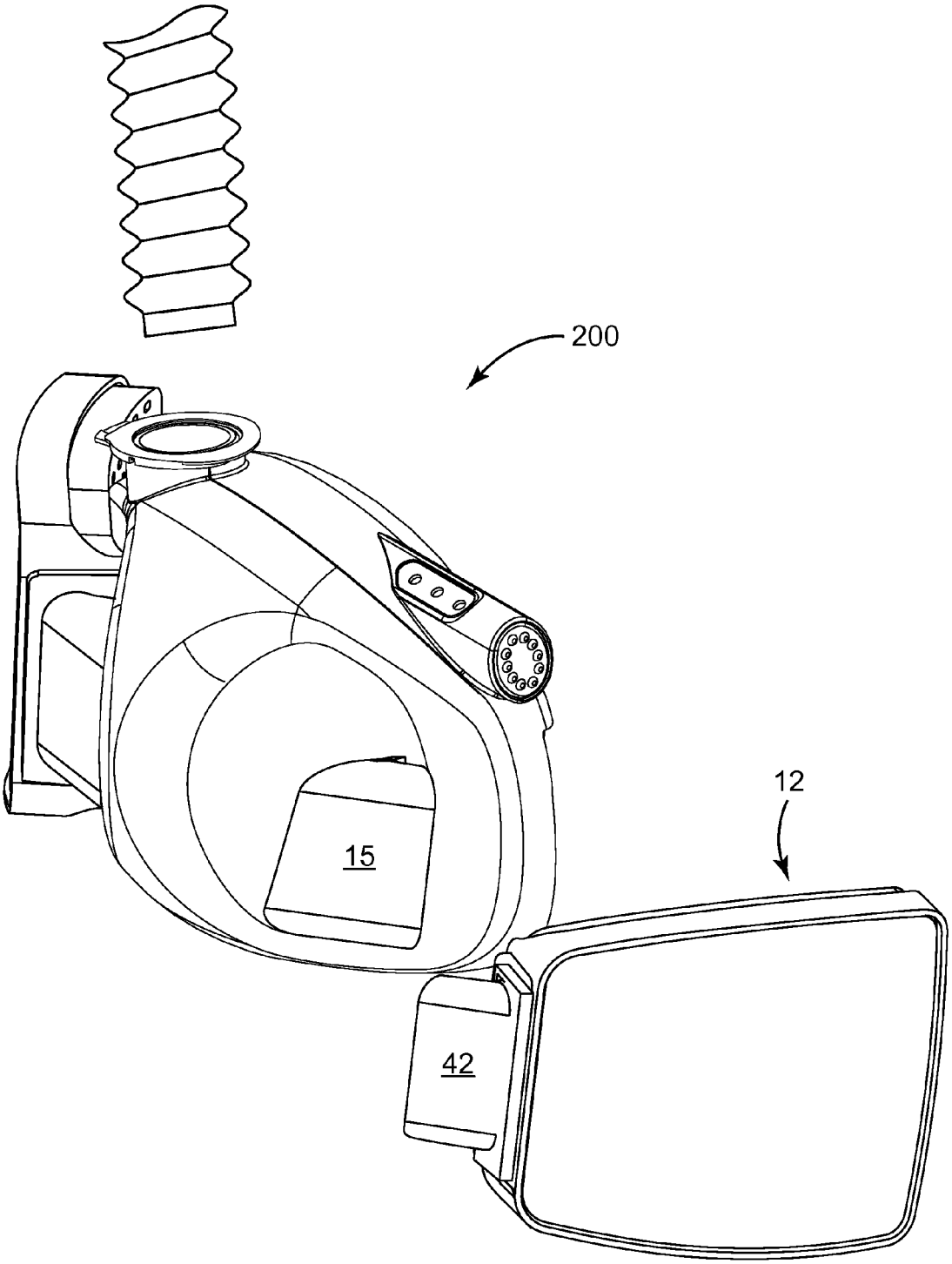
FIG. 8 is a perspective view of a illustrative positive air pressure respirator (PAPR) and a disengaged sleeve-fit respirator cartridge.

FIG. 7 is a perspective view of a illustrative full mask respirator 100 and a disengaged sleeve-fit respirator cartridge 12. FIG. 8 is a perspective view of a illustrative Positive Air Pressure Respirator (PAPR) 200 and a disengaged sleeve-fit respirator cartridge 12. As described above, the respirator apparatus 100, 200 includes a filter cartridge receiver 15 integral with and extending from the respirator body and a filter cartridge 12. The filter cartridge 12 includes a nozzle element 42 defining an airflow channel and being integral with a cartridge sidewall. The respirator body and filter cartridge 12 are configured to be fluidically coupled through sleeve-fit engagement between the filter cartridge receiver 15 and nozzle element 42. Any of the attachment embodiments described herein can be implemented with the respirator apparatus 100, 200 illustrated in FIG. 7 and FIG. 8.

The complete disclosures of the patents, patent documents, and publications cited herein are incorporated by reference in their entirety as if each were individually incorporated. Various modifications and alterations to this disclosure will become apparent to those skilled in the art without departing from the scope and spirit of this disclosure. It should be understood that this disclosure is not intended to be unduly limited by the illustrative embodiments and examples set forth herein and that such examples and embodiments are presented by way of example only with the scope of the disclosure intended to be limited only by the claims set forth herein as follows.

What is claimed is:

1. A respirator apparatus, comprising:

a respirator body;

a filter cartridge receiver integral with the respirator body;

a filter cartridge comprising a nozzle element integral with the filter cartridge, wherein the respirator body and the filter cartridge are configured to be fluidically coupled without relative rotation through sleeve-fit engagement between the filter cartridge receiver and the nozzle element, and wherein the filter cartridge receiver and the nozzle element define an airflow channel; and a cantilever latch integral with the filter cartridge, the respirator body further comprising a mating surface that cooperates with the cantilever latch to secure the nozzle element to the filter cartridge receiver.

2. A respirator apparatus according to claim 1, wherein the cantilever latch extends from the nozzle element.

3. A respirator apparatus, comprising:

a respirator body;

a filter cartridge receiver integral with the respirator body; and a filter cartridge comprising a nozzle element integral with the filter cartridge, wherein the respirator body and the filter cartridge are configured to be fluidically coupled without relative rotation through sleeve-fit engagement between the filter cartridge receiver and the nozzle element, wherein the filter cartridge receiver and the nozzle element define an airflow channel, wherein the filter cartridge further comprises a pair of cantilever latches integral with and extending from a cartridge sidewall and being substantially parallel with the nozzle element, and the nozzle element positioned between the pair of cantilever latches.

4. A respirator apparatus, comprising:

a respirator body;

a filter cartridge receiver integral with the respirator body; and a filter cartridge comprising a nozzle element integral with the filter cartridge, wherein the respirator body and the filter cartridge are configured to be fluidically coupled without relative rotation through sleeve-fit engagement between the filter cartridge receiver and the nozzle element, wherein the filter cartridge receiver and the nozzle element define an airflow channel, and wherein the filter cartridge comprises a cartridge sidewall extending between a first and second major surface of the filter cartridge and the nozzle element being integral with the cartridge sidewall, and wherein a cantilever latch extends from the cartridge sidewall and is substantially parallel with the nozzle element.

5. A respirator apparatus as in any one of claim 1, claim 3, or claim 4, wherein the filter cartridge receiver comprises a mating surface that cooperates with the cantilever latch to secure the nozzle element to the filter cartridge receiver.

6. A respirator apparatus as in any one of claim 1, claim 3, or claim 4, wherein the filter cartridge receiver comprises a first alignment feature and the nozzle element comprises a second alignment feature and the first alignment feature cooperates with the second alignment feature to register the nozzle element to the filter cartridge receiver.

7. A respirator apparatus according to claim 6, wherein the first alignment feature cooperates with the second alignment feature to align and secure the nozzle element to the filter cartridge receiver.

8. A respirator apparatus, comprising:

a respirator body;

a filter cartridge receiver integral with the respirator body; and a filter cartridge comprising a nozzle element integral with the filter cartridge, wherein the respirator body and the filter cartridge are configured to be fluidically coupled without relative rotation through sleeve-fit engagement between the filter cartridge receiver and the nozzle element, wherein the filter cartridge receiver and the nozzle element define an airflow channel, wherein the filter cartridge receiver comprises a first alignment feature and the nozzle element comprises a second alignment feature, and the first alignment feature cooperates with the second alignment feature to register the nozzle element to the filter cartridge receiver, and wherein one of the first alignment feature and the second alignment feature is an elongated protrusion that is parallel with a direction of the sleeve-fit engagement.

9. A respirator apparatus as in any one of claim 1, claim 3, claim 4, or claim 8, wherein the respirator body comprises a full face mask respirator or a half mask respirator.

10. A respirator apparatus as in any one of claim 1, claim 3, claim 4, or claim 8, wherein the respirator body comprises a positive air pressure respirator (PAPR).

11. A respirator cartridge comprising:

a nozzle element defining an airflow channel and being integral with a filter cartridge, and configured to be fluidically coupled without relative rotation to a filter cartridge receiver; and a cantilever latch adjacent the nozzle element and extending from the filter cartridge, wherein the cantilever latch comprises a push button protrusion located along a length of the cantilever latch, wherein the push button protrusion is configured to detach the filter cartridge from a respirator article.

12. A respirator cartridge comprising:

a nozzle element defining an airflow channel and being integral with a filter cartridge, and configured to be fluidically coupled without relative rotation to a filter cartridge receiver; and cantilever latch adjacent the nozzle element and extending from the filter cartridge, wherein the cantilever latch comprises a push button protrusion located at a distal end of the cantilever latch.

13. A respirator cartridge as in any one of claim 11 or claim 12, wherein the cantilever latch comprises an anchoring protrusion located along a length of the cantilever latch, wherein the anchoring protrusion is configured to secure the filter cartridge to a respirator article.

14. A respirator cartridge according as in any one of claim 11 or claim 12, wherein the cantilever latch comprises an anchoring protrusion located at a distal end of the cantilever latch.

15. A respirator cartridge as in any one of claim 11 or claim 12, wherein the cantilever latch comprises an anchoring protrusion element that is configured to both secure the filter cartridge to a respirator article and to detach the filter cartridge from a respirator article and the anchoring protrusion element is located along a length of the cantilever latch.

16. A respirator cartridge as in any one of claim 11 or claim 12, wherein the filter cartridge comprises a cartridge sidewall extending between a first and second major surface, the filter cartridge and the nozzle element being integral with the cartridge sidewall.

* * * * *